US008720811B2

(12) United States Patent
Zink

(10) Patent No.: US 8,720,811 B2
(45) Date of Patent: May 13, 2014

(54) APPARATUS AND METHOD FOR STORING AND DISPENSING A PRESSURE HOSE

(75) Inventor: Gerald P. Zink, Durango, CO (US)

(73) Assignee: Stoneage, Inc., Durango, CO (US)

( * ) Notice: Subject to any disclaimer, the term of this patent is extended or adjusted under 35 U.S.C. 154(b) by 587 days.

(21) Appl. No.: 13/041,791

(22) Filed: Mar. 7, 2011

(65) Prior Publication Data

US 2012/0227815 A1 Sep. 13, 2012

(51) Int. Cl.
*B65H 75/34* (2006.01)

(52) U.S. Cl.
USPC ..... 242/397.2; 242/397; 242/548.1; 254/383; 254/385

(58) Field of Classification Search
USPC ..... 242/397, 397.1, 397.2, 397.3, 548.1, 242/390, 390.2, 172; 254/287, 295, 383, 254/385, 371, 374; 137/355.12, 355.19
See application file for complete search history.

(56) References Cited

U.S. PATENT DOCUMENTS

| | | | | |
|---|---|---|---|---|
| 3,563,481 | A | 2/1971 | Stahmer | |
| 3,709,252 | A | 1/1973 | Bishop | |
| 3,776,519 | A | 12/1973 | Hamilton | |
| 3,939,862 | A | 2/1976 | Booth | |
| 4,026,491 | A | 5/1977 | Bostroem | |
| 4,066,093 | A | 1/1978 | Egerstrom | |
| 4,087,060 | A | 5/1978 | Laky et al. | |
| 4,236,696 | A * | 12/1980 | Hicks et al. | 254/297 |
| 4,350,323 | A | 9/1982 | Charles et al. | |
| 4,660,782 | A | 4/1987 | Hegemann | |
| 4,685,631 | A | 8/1987 | Kurtz et al. | |
| 5,099,911 | A | 3/1992 | Vowles | |
| 5,183,218 | A | 2/1993 | Gavagna | |
| 5,186,253 | A * | 2/1993 | Gustafson et al. | 166/77.1 |
| 5,265,671 | A | 11/1993 | Vowles | |
| 5,323,800 | A | 6/1994 | Vollweiler et al. | |
| 5,364,043 | A | 11/1994 | Linderoth | |
| 5,485,972 | A | 1/1996 | Mummery et al. | |
| 5,494,235 | A | 2/1996 | Vowles | |
| 5,564,637 | A | 10/1996 | Berthold et al. | |
| 6,561,451 | B1 | 5/2003 | Steinich | |
| 6,601,791 | B2 | 8/2003 | Weimer et al. | |
| 6,742,740 | B2 * | 6/2004 | Tisbo et al. | 242/395 |

(Continued)

FOREIGN PATENT DOCUMENTS

| | | |
|---|---|---|
| EP | 0351777 | 1/1990 |
| EP | 0473234 | 3/1992 |

(Continued)

*Primary Examiner* — Sang Kim
*Assistant Examiner* — Nathaniel Adams
(74) *Attorney, Agent, or Firm* — Greenberg Traurig, LLP

(57) ABSTRACT

An apparatus for storing, rotating and feeding a high pressure hose, including: a first rotatable drum with a helical groove; a second rotatable drum; and at least one actuator for rotating the first and second drums. For rotation of the first and second drums in first and second opposite directions, respectively, a hose and a cable are coilable into the helical groove such that the hose is in compressive engagement with the cable and the first drum. For rotation of the first and second drums in the second and first directions, respectively, the hose is uncoilable from the first drum and displaceable beyond the apparatus and the cable is coilable about the second drum.

9 Claims, 7 Drawing Sheets

(56) References Cited

U.S. PATENT DOCUMENTS

| | | | |
|---|---|---|---|
| 7,178,534 | B2 | 2/2007 | Garman et al. |
| 7,210,647 | B2 | 5/2007 | Dion |
| 7,316,368 | B2 | 1/2008 | Moon et al. |
| 7,377,289 | B1 | 5/2008 | English et al. |
| 7,438,250 | B2 | 10/2008 | Anderson et al. |
| 7,810,751 | B2 | 10/2010 | Caamano et al. |
| 2008/0295894 | A1 | 12/2008 | Uffner et al. |

FOREIGN PATENT DOCUMENTS

| | | |
|---|---|---|
| JP | 57077176 | 5/1982 |
| JP | 63282055 | 11/1988 |
| JP | 1252469 | 10/1989 |
| JP | 2144382 | 6/1990 |
| WO | 9119664 | 12/1991 |
| WO | 9207786 | 5/1992 |

* cited by examiner

APPARATUS AND METHOD FOR STORING AND DISPENSING A PRESSURE HOSE

FIELD OF THE INVENTION

The present disclosure relates generally to an apparatus and method for storing, rotating, and feeding a high pressure hose. In particular, the present disclosure relates to a system and method for securing a high pressure hose in a helical groove for a hose drum by coiling a cable, belt, or strip in the helical groove.

BACKGROUND OF THE INVENTION

It is known to coil and uncoil a high pressure hose about a drum as a means of extending and retracting the hose. However, the hose reacts by uncoiling from the drum, which can cause damage to the hose and malfunction of the apparatus employing the drum and hose, as the hose is pressurized, due to frictional forces resisting hose extension during displacement beyond the apparatus, due to gravity, for example, for uphill extension, or due to jet nozzle reaction force. U.S. Pat. No. 5,494,235 (Vowles; Robert W.) teaches a device for winding a high-pressure hose in a spiral groove of a drum and for dispensing the hose from the device. The device uses peripheral rollers to exert force on the coiled hose to keep the hose in the groove. The rollers cause drag on the hose during extension, causing uncoiling, kinking, and wear to the surface of the hose, and generally add to the size, cost, and complexity of the device.

SUMMARY OF THE INVENTION

According to aspects illustrated herein, there is provided an apparatus for storing, rotating and feeding a high pressure hose, including: a first rotatable drum with a helical groove; a second rotatable drum; and at least one actuator for rotating the first and second drums. For rotation of the first and second drums in first and second opposite directions, respectively, a hose and a cable are coilable into the helical groove such that the hose is in compressive engagement with the cable and the first drum. For rotation of the first and second drums in the second and first directions, respectively, the hose is uncoilable from the first drum and displaceable beyond the apparatus and the cable is coilable about the second drum.

According to aspects illustrated herein, there is provided an apparatus for storing, rotating and feeding a high pressure hose, including: the high pressure hose; a housing; a first rotatable drum disposed within the housing and including a helical groove into which at least a portion of the hose is disposed; a second rotatable drum disposed within the housing; a cable with a first end fixed to the first drum and a second end fixed to the second drum. Respective portions of the cable are disposed about the first and second drums. At least one actuator for rotating the first and second drums. The apparatus includes an outlet assembly including an outlet element and a threaded rod engaged with the output element and rotatable by the actuator. For rotation of the first and second drums in first and second opposite directions, respectively, the hose and the cable are coilable into the helical groove such that the hose is held in compressive engagement with the first drum by contact with the cable. For rotation of the first and second drums in the second and first directions, respectively, the hose is uncoilable from the first drum and displaceable through the outlet element and the cable is coilable about the second drum. The threaded rod is rotatable so that the outlet element is aligned with a portion of the helical groove from which the hose is uncoiling or into which the hose is coiling.

According to aspects illustrated herein, there is provided a method for storing, rotating and feeding a high pressure hose, including: rotating, using at least one actuator for an apparatus, a first drum for the apparatus in a first rotational direction to coil the high pressure hose and a cable in a helical groove for the first drum; rotating, using the at least one actuator, a second drum for the apparatus in a second rotational direction, opposite the first rotational direction, to uncoil the cable from the second drum; compressively engaging the hose, the cable, and the helical groove; rotating, using the at least one actuator, the first drum in the second rotational direction to uncoil the high pressure hose and the cable from the helical groove and displace the high pressure hose from the first drum; and rotating, using the at least one actuator, the second drum in the first rotational direction to coil the cable about the second drum.

According to aspects illustrated herein, there is provided a method for storing, rotating and feeding a high pressure hose, including: rotating, using at least one actuator for an apparatus, a first drum for the apparatus in a first rotational direction to coil the high pressure hose and a cable in a helical groove for the first drum such that the cable places the hose in compressive engagement with the first drum; rotating, using the at least one actuator, a second drum for the apparatus in a second rotational direction, opposite the first rotational direction, to uncoil the cable from the second drum; rotating, using the at least one actuator, the first drum in the second rotational direction to uncoil the high pressure hose and cable from the helical groove and displace the high pressure hose through an outlet element for the apparatus; rotating, using the at least one actuator, the second drum in the first rotational direction to coil the cable about the second drum; and rotating, with the actuator, a threaded rod engaged with the outlet element such that the outlet element is aligned with a portion of the helical groove from which the hose is uncoiling or into which the hose is coiling.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF THE PREFERRED EMBODIMENT

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

It should be understood that the use of "or" in the present application is with respect to a "non-exclusive" arrangement, unless stated otherwise. For example, when saying that "item x is A or B," it is understood that this can mean one of the following: 1) item x is only one or the other of A and B; and 2) item x is both A and B. Alternately stated, the word "or" is not used to define an "exclusive or" arrangement. For example, an "exclusive or" arrangement for the statement "item x is A or B" would require that x can be only one of A and B.

Figure 1A:
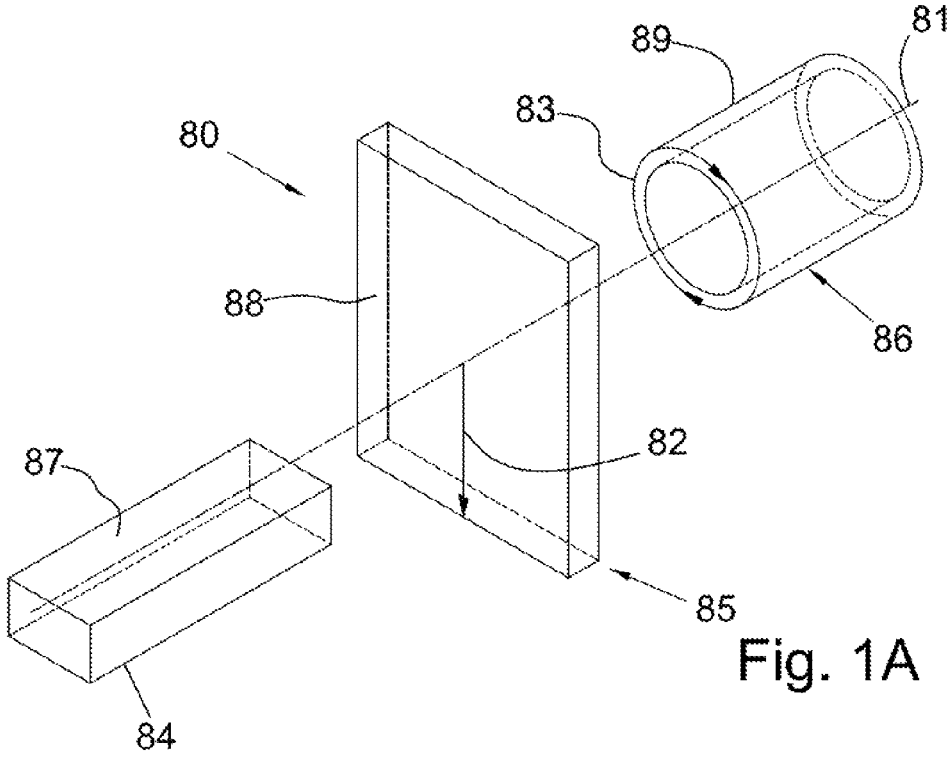
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present disclosure is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential surface. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
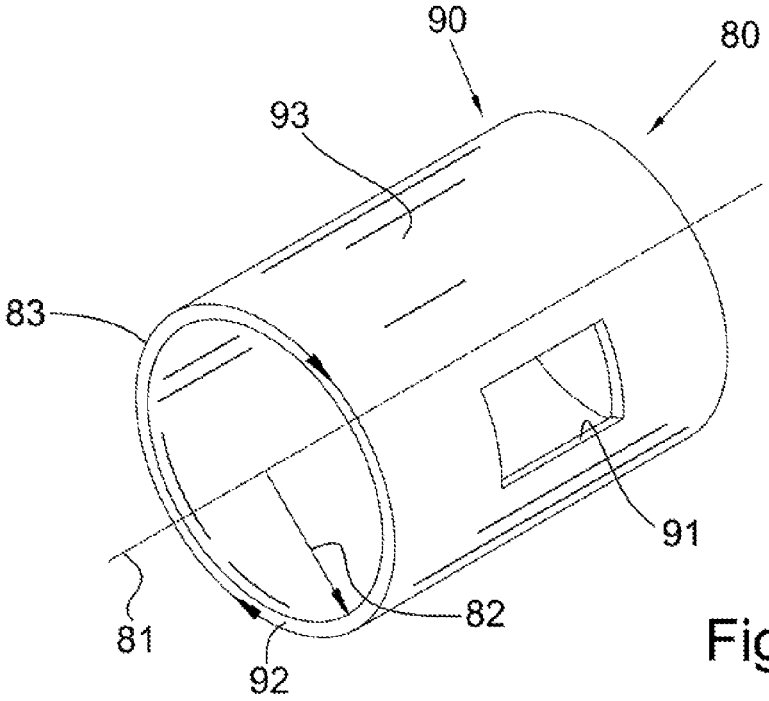
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present disclosure in any manner. Object 90 includes axial surface 91, radial surface 92, and circumferential surface 93. Surface 91 is part of an axial plane, surface 92 is part of a radial plane, and surface 93 is part of a circumferential surface.

Figure 2:
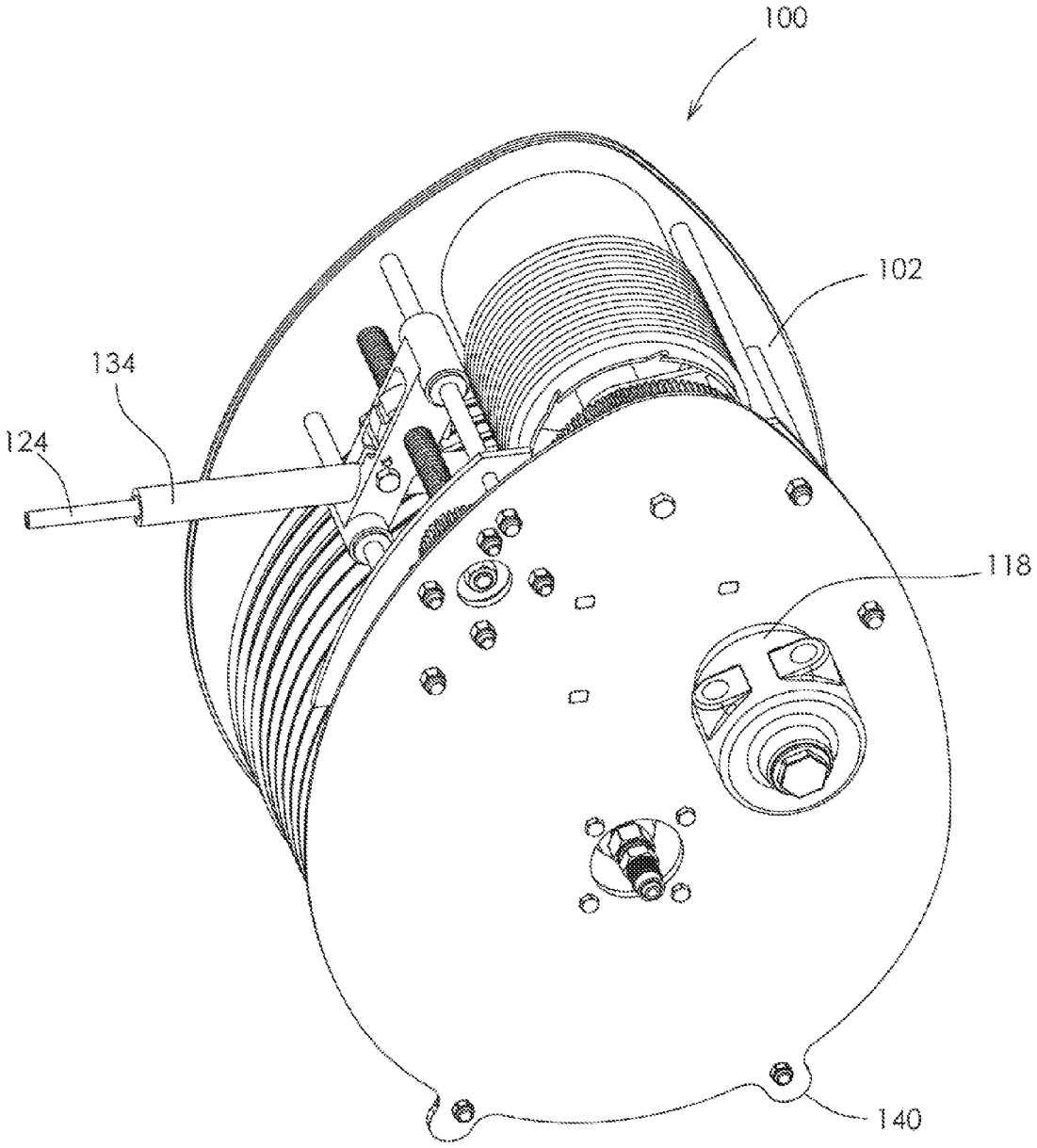
FIG. 2 is a perspective view of an apparatus for storing, rotating and feeding a high pressure hose.

FIG. 2 is a perspective view of apparatus 100 for storing, rotating and feeding a high pressure hose.

Figure 3:
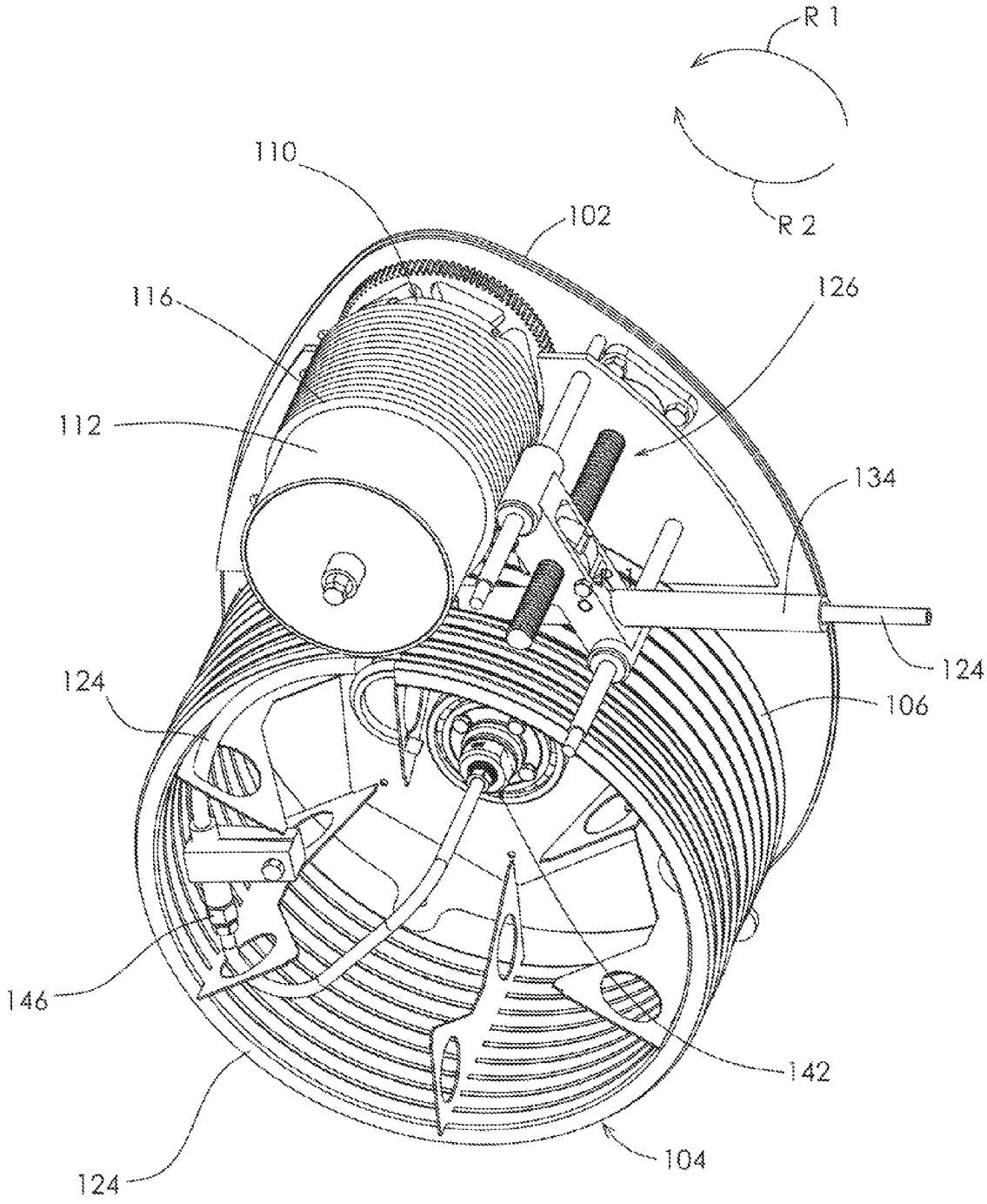
FIG. 3 is a perspective view of the apparatus shown in FIG. 2, with a portion of the housing removed.

FIG. 3 is a perspective view of apparatus 100 shown in FIG. 2, with a portion of housing 102 removed.

Figure 4:
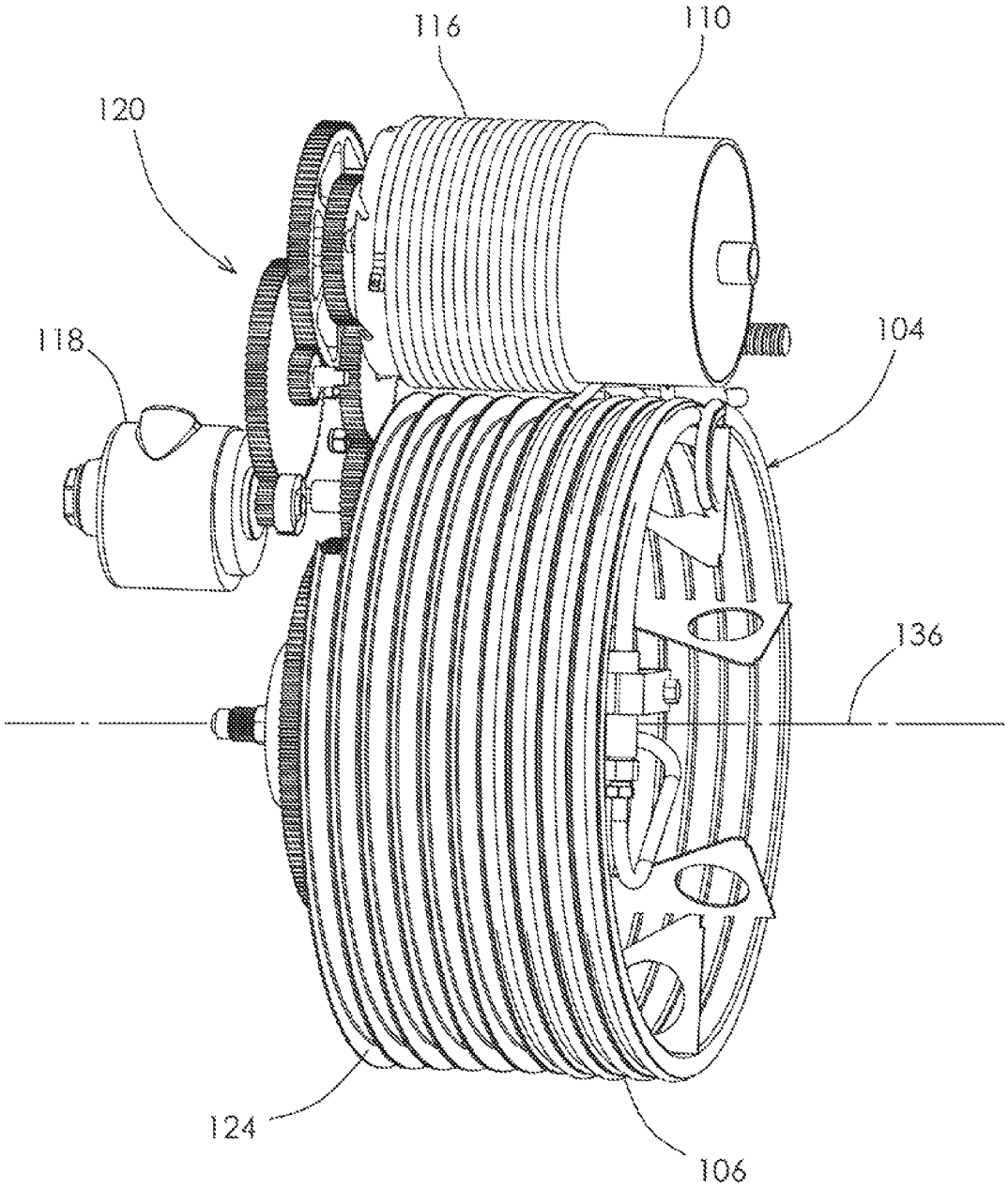
FIG. 4 is a perspective view of the drums and actuation system shown in FIG. 3.

FIG. 4 is a perspective view of the drums and actuation system shown in FIG. 3.

Figure 5:
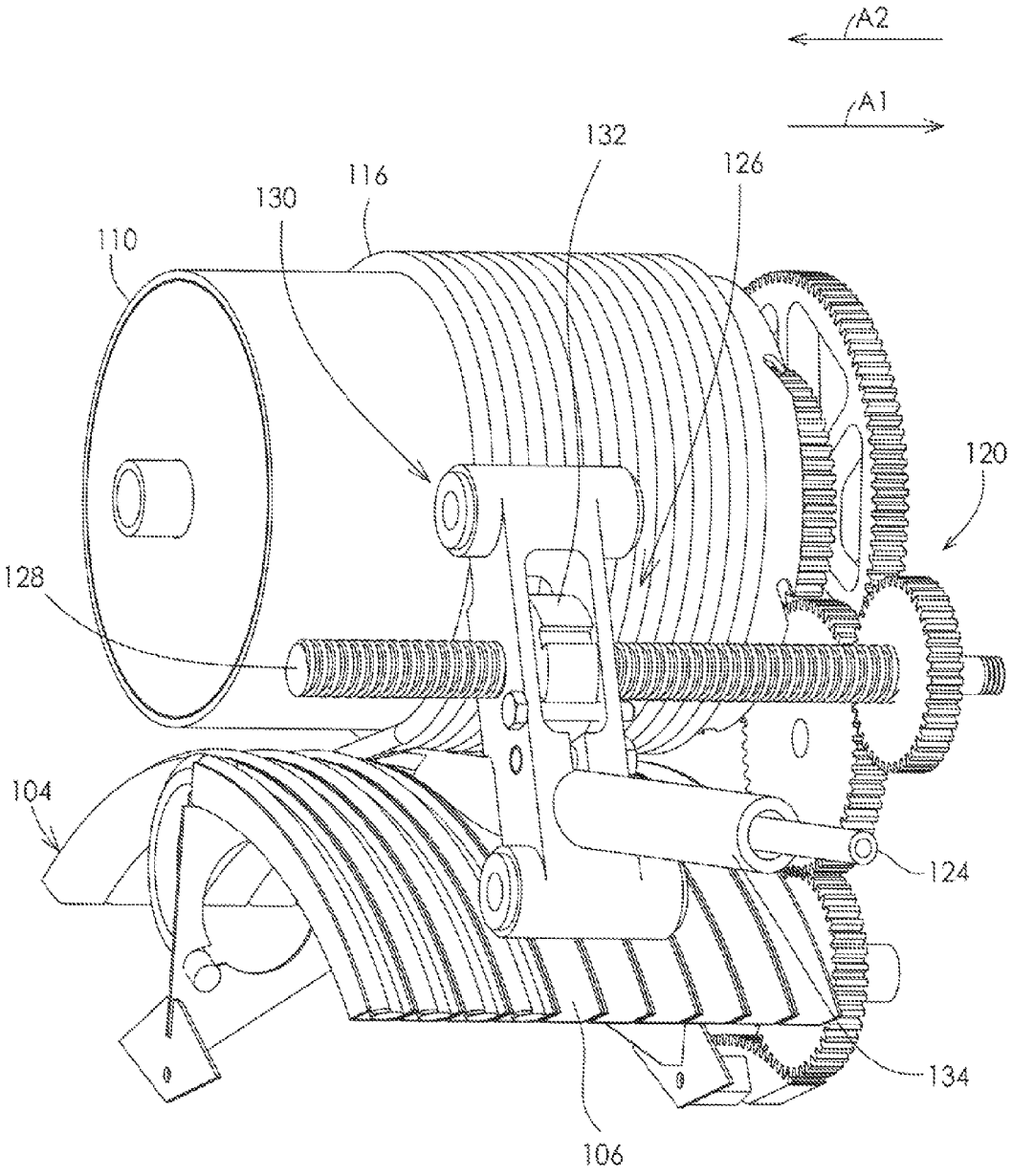
FIG. 5 is a perspective view of a portion of the drums and outlet assembly shown in FIG. 3.

FIG. 5 is a perspective view of a portion of the drums and outlet assembly shown in FIG. 3. The following should be viewed in light of FIGS. 2 through 5. Apparatus 100 includes rotatable hose drum 104 with helical groove 106 in an outer circumferential surface of drum 104, and rotatable cable drum 110. One end of cable 116 is fixed to the cable drum and the other end of the cable is fixed to the hose drum. As further described below, the cable coils and uncoils between the hose and cable drums.

Figure 6:
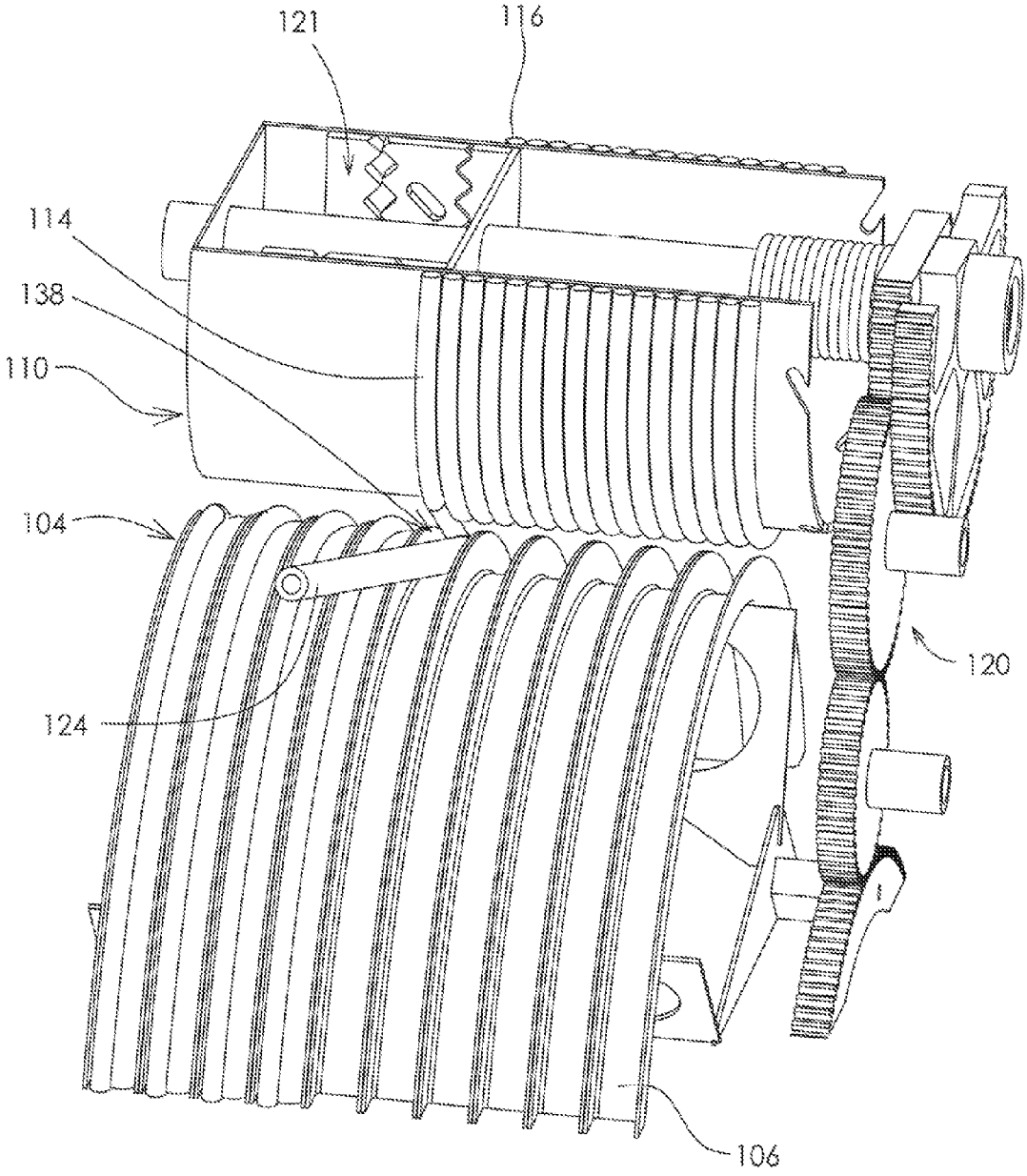
FIG. 6 is a perspective view of a portion of the drums and actuation system shown in FIG. 3, with the cable drum cut-away; and, FIG. 7 is a perspective view of a portion of the drums and actuation system shown in FIG. 3, with the hose and cable drums partially cut-away.

FIG. 6 is a perspective view of a portion of the drums and actuation system shown in FIG. 3, with the cable drum cut-away. The following should be viewed in light of FIGS. 2 through 6. The apparatus also includes at least one actuator 118 for rotating drums 104 and 110. Actuator 118 can be any actuator known in the art. In an example embodiment, the actuator is a pneumatic actuator. In an example embodiment, the apparatus includes a single actuator 118 and gear set 120 is used to rotate both drums using the actuator. Gearset 120 can be any gear set known in the art.

In an example embodiment, drum 110 includes clutch and torsion spring assembly 121. Assembly 121 can be any clutch and torsion spring assembly known in the art. Drums 104 and 110 are rotated by the actuator so that the hose and cable drums synchronously rotate in order such that in combination with assembly 121, sufficient tension is maintained on the cable as the cable coils about or uncoils from the cable drum, or coils about or uncoils from the hose drum. For example, gear set 120 is configured to implement the synchronous rotation. By sufficient tension we mean that the cable is firmly engaged in helical groove 106 and about drum 110 without applying excessive radial force on the hose drum or the cable drum, for example, force that might strain the cable, unduly hinder or stall rotation of the hose drum or cable drum, or crush the hose.

Hose 124 is used with apparatus 100. Hose 124 can be any hose known in the art, for example, a high pressure hose. For rotation of drum 104 by the actuator in direction R1, and rotation of drum 110 by the actuator in direction R2, opposite direction R1, hose 124 and cable 114 coil into helical groove 106 such that the hose is in compressive or frictional engagement with helical groove 106. That is, the cable holds the hose in place in groove 106, preventing the hose from displacing radially outward when the hose is pressurized and or extended. For example, the cable exerts a pressure on the hose in axial direction A1 to force the hose into a compressive or frictional engagement with groove 106. Thus, rotating drums 104 and 110 in directions R1 and R2, respectively, causes a portion of the cable to uncoil from drum 110 and coil about drum 104. It should be appreciated that as the hose is coiled into helical groove 106, the hose is drawn into the housing through the outlet assembly.

For rotation of drums 104 and 110 by the actuator in directions R2 and R1, respectively: the hose uncoils from drum 104 and is displaced beyond the apparatus, for example, through outlet assembly 126; and the cable coils about drum 110. Thus, rotating drums 104 and 110 in directions R2 and R1, respectively, causes a portion of the cable to uncoil from drum 104 and coil about drum 110.

Figure 7:
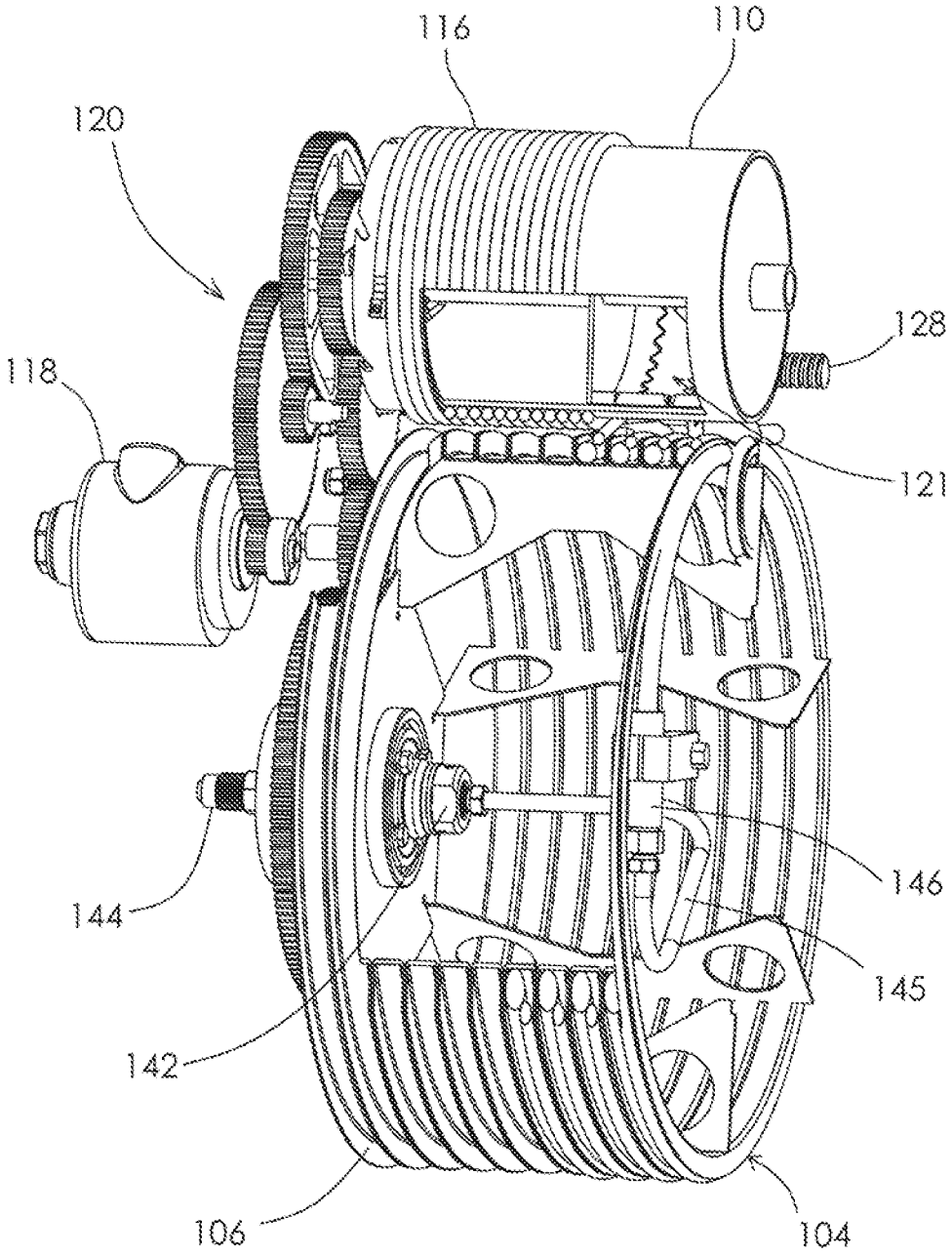

FIG. 7 is a perspective view of a portion of the drums and actuation system shown in FIG. 3, with the hose and cable drums partially cut-away. The following should be viewed in light of FIGS. 2 through 7. In an example embodiment, the outlet assembly includes displacement component 128 and outlet element 130. Component 128 is fixed with respect to the housing and rotatable by the actuator and gear set. In an example embodiment, component 128 is a threaded rod, or screw, and the output element includes nut 132 fixed to the output element and matingly engaged with the threaded rod. In an example embodiment, element 130 includes tube 134 through which the hose passes.

In an example embodiment, there are two modes of operation for apparatus 100. In a first mode, drums 104 and 110 are displaceable with respect to the outlet element. That is, drums 104 and 110 are displaceable along axis of rotation 136 for drum 104 such that portion 138 of the helical groove, from which the hose is being uncoiled or into which the hose is being coiled, is aligned with the outlet element, in particular, tube 132. In a second mode: the outlet element is displaceable with respect to drums 104 and 11. That is, the outlet element is displaceable along axis 136 such that the outlet element is aligned with portion 138. Thus, in either mode, the hose can transit from drum 104 through the outlet, for example, tube 132 without kinking, abrasion, or excessive contact. For example, the hose does not need to bend to pass from drum 104 to the tube.

As an example of the first mode, the output element is fixed in a position, for example, tube 134 is fixed to an orifice into which hose 124 is to be fed. To feed hose 124 into the orifice, drums 104 and 110 are rotated in directions R2 and R1, respectively, and rod 128 is rotated in direction R1. In response to the rotation of the rod, either the rod or element 130 axially displaces parallel to axis 136. In the first mode, element 130 and nut 132 are fixed due to the engagement of the tube with the orifice, therefore, the rod displaces in axial direction A1. Since the rod is fixed with respect to the housing, the housing and drums 104 and 110 also displace in direction A1 with the rod. Thus, drums 104 and 110 axially displace in direction A1 to keep portion 138 aligned with the fixed tube. To facilitate the axial displacement of the housing, it may be suspended or supported to facilitate movement in direction A1 or A2. For example, legs 140 of the housing can be so configured, or rollers (not shown) could be installed at the legs, or the housing can be supported by a trolley on a beam above the housing. To withdraw the hose, the rotational directions are reversed.

As an example of the second mode, the housing is fixed in a position and tube 134 is not fixed to an orifice into which hose 124 is to be fed. To feed hose 124 into the orifice, drums 104 and 110 are rotated in direction R2 and R1, respectively, and rod 128 is rotated in direction R1. As noted above, in response to the rotation of the rod, either the rod or element 130 axially displaces parallel to axis 136. In the second mode, the housing, and thus the rod, are fixed axially; therefore, the output element displaces in axial direction A2, opposite direction A1. Thus, output element 130 axially displaces to keep portion 138 aligned with the tube. In the second mode, in one embodiment, the hose flexes between tube 134 and the orifice as the output element traverses the rod. In the second mode, in one embodiment, tube 134 is flexible to facilitate the movement of the hose from tube 134 to the orifice. To withdraw the hose, the rotational directions are reversed.

Apparatus 100 includes rotating high pressure connection 142. Connection 142 can be any rotating high pressure connection known in the art. A high pressure fluid source is connected to inlet 144, which remains stationary as drum 104 is rotated. Tube 145 connects the hose to the high pressure rotary connection 142.

As noted above, when a hose coiled about a drum is pressurized and or extended, the hose reacts by uncoiling from the drum, which can damage the hose and foul operation of the apparatus containing the drum. Advantageously, cable 116 acts to hold hose 124 in place about the drum. For example, as noted above, cable 116 exerts a force on the hose that places the hose in compressive or frictional engagement with drum 104 and the cable. This compressive or frictional engagement holds, in particular with respect to a radially outward direction, the hose in the spiral groove.

Hose 124 is shown without a nozzle or other fitting. It should be understood that apparatus 100 and hose 124 can be used for any suitable high pressure fluid application known in the art.

The following is a description of a method for storing, rotating and feeding a high pressure hose. Although the method is depicted as a sequence for clarity, no order should be inferred from the sequence unless explicitly stated. The following should be viewed in light of FIGS. 2-8. A first step rotates, using at least one actuator for an apparatus, a first drum for the apparatus in a first rotational direction to coil the high pressure hose and a cable in a helical groove for the first drum. A second step rotates, using the at least one actuator, a second drum for the apparatus in a second rotational direction, opposite the first rotational direction, to uncoil the cable from the second drum. A third step compressively engages the hose, the cable, and the helical groove. A fourth step rotates, using the at least one actuator, the first drum in the second rotational direction to uncoil the high pressure hose from the helical groove and displace the high pressure hose from the first drum. A fifth step rotates, using the at least one actuator, the second drum in the first rotational direction to coil the cable about the second drum.

In an example embodiment, the apparatus includes a housing and an outlet element; and the first and second rotatable drums are disposed within the housing. Rotating the first and second drums in the first and second directions, respectively, includes uncoiling a first portion of the cable from the second drum. Compressively engaging the hose, the cable, and the helical groove includes urging, with the cable, the hose into a compressive engagement with a radially disposed portion of the helical groove. Rotating the first and second drums in the second and first directions, respectively, includes uncoiling a second portion of the cable from the first drum; and displacing the high pressure hose from the first drum includes displacing the hose through the outlet element.

In an example embodiment, the first drum is displaceable with respect to the outlet element; and the first drum is displaceable along an axis of rotation for the first drum such that a portion of the helical groove, from which the hose is being uncoiled or into which the hose is being coiled, is aligned with the outlet element. In an example embodiment, the outlet element is displaceable with respect to the first drum; and the outlet is displaceable along an axis of rotation for the first drum such that the outlet is aligned with a portion of the helical groove from which the hose is being uncoiled or into which the hose is being coiled.

In an example embodiment, the apparatus includes a displacement component engaged with the outlet element and the method includes rotating the displacement component with the at least one actuator such that: the outlet displaces along an axis of rotation for the displacement component in response to rotation of the displacement component; or the displacement component displaces with respect to the outlet element in response to rotation of the displacement component.

In an example embodiment, the displacement component includes a threaded rod and the method includes: rotating the threaded rod in a third rotational direction such that: the first drum rotates in the first rotational direction and displaces in a first axial direction; or the first drum rotates in the first rotational direction and the outlet displaces in a second axial direction, opposite the first axial direction; and rotating the threaded rod in a fourth rotational direction, opposite the third rotational direction such that: the first drum rotates in the second rotational direction and displaces in the second axial direction; or the first drum rotates in the second rotational direction and the outlet displaces in the first axial direction.

In an example embodiment, coiling a cable in the helical groove such that the hose is in compressive engagement with the helical groove includes exerting, with the cable, a pressure on the hose in an axial direction. In an example embodiment, the method includes connecting a first end of the cable to the first drum and a second end of the cable to the second drum.

The following is a description of a method for storing, rotating and feeding a high pressure hose. Although the method is depicted as a sequence for clarity, no order should be inferred from the sequence unless explicitly stated. The following should be viewed in light of FIGS. 2-8. One step rotates, using at least one actuator for an apparatus, a first drum for the apparatus in a first rotational direction to coil the high pressure hose in a helical groove for the first drum. Another step rotates, using the at least one actuator, a second drum for the apparatus in a second rotational direction, opposite the first rotational direction, to uncoil the cable from the second drum. A further step rotates, using the at least one actuator, the first drum in the second rotational direction to uncoil the high pressure hose and cable from the helical groove and displace the high pressure hose through an outlet element for the apparatus. A still further step rotates, using the at least one actuator, the second drum in the first rotational direction to coil the cable about the second drum. A yet further step rotates, with the actuator, a threaded rod engaged with the outlet element such that the outlet element is aligned with a portion of the helical groove from which the hose is uncoiling or into which the hose is coiling.

Thus, it is seen that the objects of the invention are efficiently obtained, although changes and modifications to the invention should be readily apparent to those having ordinary skill in the art, without departing from the spirit or scope of the invention as claimed. Although the invention is described by reference to a specific preferred embodiment, it is clear that variations can be made without departing from the scope or spirit of the invention as claimed.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method for storing, rotating and feeding a high pressure hose, comprising:

rotating, using at least one actuator for an apparatus, a first drum for the apparatus in a first rotational direction to coil the high pressure hose and a cable in a helical groove for the first drum;

rotating, using the at least one actuator, a second drum for the apparatus in a second rotational direction, opposite the first rotational direction, to uncoil the cable from the second drum;

compressively engaging the hose, the cable, and the helical groove, wherein the cable presses the hose radially inward to retain the hose in the groove;

rotating, using the at least one actuator, the first drum in the second rotational direction to uncoil the high pressure hose and the cable from the helical groove and displace the high pressure hose from the first drum; and, rotating, using the at least one actuator, the second drum in the first rotational direction to coil the cable about the second drum.

2. The method of claim 1, wherein:

the apparatus includes a housing and an outlet element;

the first and second rotatable drums are disposed within the housing;

rotating the first and second drums in the first and second directions, respectively, includes uncoiling a first portion of the cable from the second drum;

compressively engaging the hose, the cable, and the helical groove includes urging, with the cable, the hose into a compressive engagement with a radially disposed portion of the helical groove;

rotating the first and second drums in the second and first directions, respectively, includes uncoiling a second portion of the cable from the first drum; and, displacing the high pressure hose from the first drum includes displacing the hose through the outlet element.

3. The method of claim 2, wherein:

the first drum is displaceable with respect to the outlet element; and, the first drum is displaceable along an axis of rotation for the first drum such that a portion of the helical groove, from which the hose is being uncoiled or into which the hose is being coiled, is aligned with the outlet element.

4. The method of claim 2, wherein:

the outlet element is displaceable with respect to the first drum; and, the outlet element is displaceable along an axis of rotation for the first drum such that the outlet element is aligned with a portion of the helical groove from which the hose is being uncoiled or into which the hose is being coiled.

5. The method of claim 2, wherein the apparatus further comprises a displacement component engaged with the outlet element, the method further comprising rotating the displacement component with the at least one actuator such that: the outlet element displaces along an axis of rotation for the threaded rod in response to rotation of the displacement component; or, the threaded rod displaces with respect to the outlet element in response to rotation of the displacement component.

6. The method of claim 5, wherein the displacement component includes a threaded rod, the method further comprising:

rotating the threaded rod in a third rotational direction such that:

the first drum rotates in the first rotational direction and displaces in a first axial direction; or, the first drum rotates in the first rotational direction and the outlet displaces in a second axial direction, opposite the first axial direction; and, rotating the threaded rod in a fourth rotational direction, opposite the third rotational direction such that:

the first drum rotates in the second rotational direction and displaces in the second axial direction; or, the first drum rotates in the second rotational direction and the outlet element displaces in the first axial direction.

7. The method of claim 1, wherein coiling a cable in the helical groove such that the hose is in compressive engagement with the helical groove includes exerting, with the cable, a pressure on the hose in a radially inward direction.

8. The method of claim 1, further comprising connecting a first end of the cable to the first drum and a second end of the cable to the second drum.

9. A method for storing, rotating and feeding a high pressure hose, comprising:

rotating, using at least one actuator for an apparatus, a first drum for the apparatus in a first rotational direction to coil the high pressure hose and a cable in a helical groove for the first drum such that the cable presses radially inward on the hose and thereby places the hose in compressive engagement with the first drum;

rotating, using the at least one actuator, a second drum for the apparatus in a second rotational direction, opposite the first rotational direction, to uncoil the cable from the second drum;

rotating, using the at least one actuator, the first drum in the second rotational direction to uncoil the high pressure hose and cable from the helical groove and displace the high pressure hose through an outlet element for the apparatus;

rotating, using the at least one actuator, the second drum in the first rotational direction to coil the cable about the second drum; and, rotating, with the actuator, a threaded rod engaged with the outlet element such that the outlet element is aligned with a portion of the helical groove from which the hose is uncoiling or into which the hose is coiling.

* * * * *

UNITED STATES PATENT AND TRADEMARK OFFICE

CERTIFICATE OF CORRECTION

PATENT NO. : 8,720,811 B2
APPLICATION NO. : 13/041791
DATED : May 13, 2014
INVENTOR(S) : Zink It is certified that error appears in the above-identified patent and that said Letters Patent is hereby corrected as shown below:

In the Specification

In Column 4, Line 45, delete “and or” and insert -- and/or --, therefor.

In Column 5, Line 13, delete “tube 132.” and insert -- tube 134. --, therefor.

In Column 5, Lines 17-18, delete “tube 132” and insert -- tube 134 --, therefor.

In Column 5, Line 64, delete “and or” and insert -- and/or --, therefor.

In the Claims

In Column 8, Lines 55-56, in Claim 6, delete “direction, opposite the first axial direction;” and insert -- direction; --, therefor.

Signed and Sealed this
Twenty-sixth Day of August, 2014

Michelle K. Lee

Michelle K. Lee
*Deputy Director of the United States Patent and Trademark Office*